United States Patent [19]

Niemi

[11] 4,422,579

[45] Dec. 27, 1983

[54] FEEDING DEVICE FOR A JET MILL

[76] Inventor: Jouko Niemi, 33960 Pirkkala 6, Pirkkala, Finland

[21] Appl. No.: 324,085

[22] Filed: Nov. 23, 1981

[30] Foreign Application Priority Data

Nov. 25, 1980 [FI] Finland ..... 803663

[51] Int. Cl.[3] ..... B02C 19/06

[52] U.S. Cl. ..... 241/39; 241/5

[58] Field of Search ..... 241/5, 39, 40, 282, 241/283, 152 A, 246, 247

[56] References Cited

U.S. PATENT DOCUMENTS 2,596,088 5/1952 Trost et al. ..... 241/39
3,215,355 11/1965 Shouvlin et al. ..... 241/247

FOREIGN PATENT DOCUMENTS 308256 10/1980 Finland .
672070 12/1929 France ..... 241/282
1583674 1/1981 United Kingdom .

*Primary Examiner*—Mark Rosenbaum
*Attorney, Agent, or Firm*—McGlew and Tuttle

[57] ABSTRACT

A device for preliminary crushing of a possibly clogged material to be ground and for feeding of the material into a jet mill containing a compressed flow of circulating grinding gas and material, so as to produce ultrafineground admixtures to be used in industry which includes a plunger and screw conveyor. The device comprises a substantially vertical plug pipe, which is at its upper end provided with a feeder funnel and which is at its bottom end, either directly or via an additional pipe, connected to the jet mill above the zone of a grinding gas nozzle. At the upper end of the plug pipe preferably in its feeder funnel, at least one plunger is provided which moves back and forth and which both crushes any clogged material and forces the crushed material as a tight plug through the pipe into the jet mill. The additional pipe carries the screw for conveying the material to the mill.

9 Claims, 3 Drawing Figures

FEEDING DEVICE FOR A JET MILL

FIELD AND BACKGROUND OF THE INVENTION

The present invention is concerned with a device for preliminary crushing of a possibly clogged, finely divided material to be ground and for feeding of the material into a jet mill containing a compressed flow of circulating grinding gas and material, so as to produce ultra-fineground admixtures to be used in industry.

In the prior art, exclusively ejector-type or injector-type feeder devices were used as feeder devices of jet mills of this type, the feeders being quite unsatisfactory in many respects, especially in view energy economy and of operation. In these prior-art devices the shifting of the material into the pressurized mill takes place by means of the grinding gas. In order to produce ultra-fineground particles, the most appropriate grinding gas is water vapour, for example the water vapour obtained from the outblow of a pulp mill boiler in accordance with the Finnish Patent Application 803,256.

During feeding, the grinding gas jet of the ejector sucks considerable quantities of air through the feeding funnel into the jet mill along with the material, which air has an adverse effect on the grinding result and on the recovery of heat from the grinding gas after the grinding. The higher viscosity of the air present during the grinding makes the grinding heterogeneous, which in particular makes the classification of the ground material more difficult.

Such a prior-art feeding device additionally imposes high requirements on the consistency of the material to be ground. The material should be preferably dry, and it should definitely not be clogged, whereas clogging, however, frequently occurs especially in winter, when the material is frozen during intermediate storage. In such a case the material must be crushed carefully before passing into the feeding funnel of the jet mill, which frequently results in unnecessary interruptions in operation.

An ejector feeder consumes about 20 percent of the total energy consumption of the grinding process.

SUMMARY OF THE INVENTION

The object of the present invention is to provide a device that replaces the ejector or injector feeder and eliminates all of the above drawbacks related to such a feeder.

The device in accordance with the present invention is characterized in that it comprises a substantially vertical so-called plug pipe, which is at its upper end provided with a feeder funnel and which is at its bottom end, either directly or via an additional pipe, connected to the jet mill above the zone of the grinding gas nozzle. At the upper end of the plug pipe, perferably in its feeder funnel, at least one pushing means is provided which is in itself known and which moves back and forth, the pushing means both crushing any clogged material and forcing the crushed material as a tight plug through the pipe into the jet mill.

The pushing means may consist of two or more separate pistons centrally arranged in the feeder funnel and moving in the direction of the plug pipe, or of a pressing roller arranged at the upper end of the plug pipe or feeder funnel and moving transversally back and forth.

For an understanding of the principles of the invention, reference is made to the following description of typical embodiments thereof as illustrated in the accompanying drawings.

The invention will be described in more detail with reference to the attached drawing, wherein.

DESCRIPTION OF THE PREFERRED EMBODIMENTS

Figure 2:
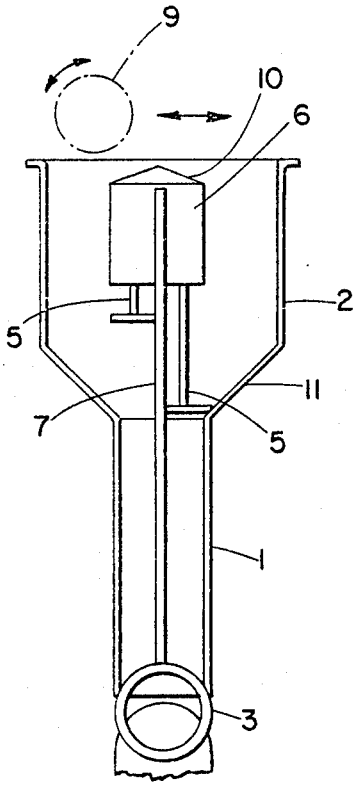
FIG. 2 shows the device as viewed from another side, with the additional pipe removed.
Figure 1:
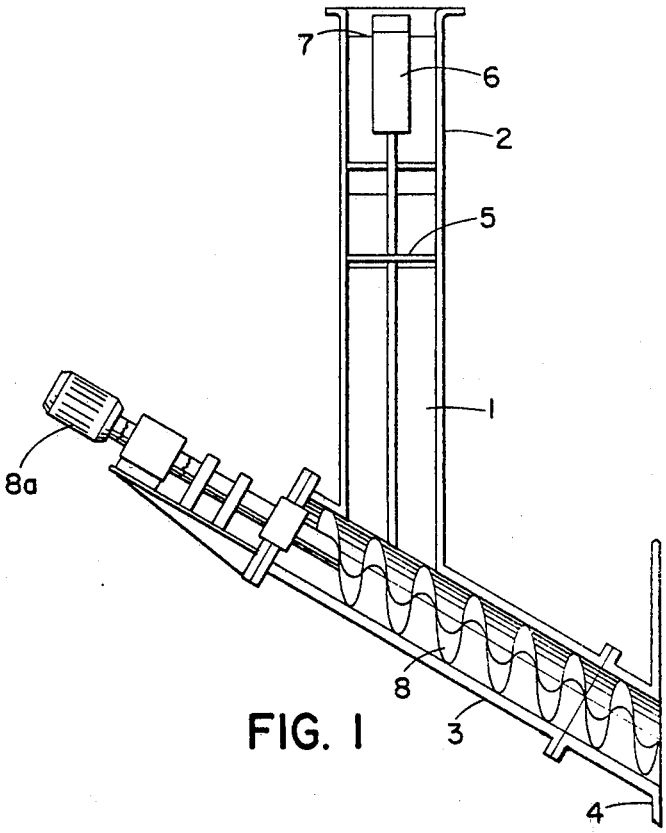
FIG. 1 is a side view of a device in accordance with the invention.
Figure 3:
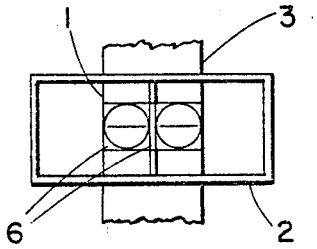
FIG. 3 is a part of the device as viewed from the top.

The device in accordance with the invention for preliminary crushing of a possibly clogged material to be ground and for feeding of the material into a jet mill 4 containing a compressed flow of circulating grinding gas and material, comprises a substantially vertical plug pipe 1, which is at its upper end provided with a feeder funnel 2 and which is at its bottom end, either directly or via an additional pipe 3, connected to the jet mill 4 above the zone of the grinding gas nozzle. At the upper end of the plug pipe 1, preferably in its feeder funnel 2, at least one pushing means 5 is provided which moves up and down, the pushing means 5 both crushing any clogged material and forcing the crushed material as a tight plug through the pipe 1, into the jet mill 4.

This device is suitable for feeding both dry and moist material, the material, by the effect of the pushing means 5, forming such a tight plug that the overpressure of 1 to 2 bar present in the jet mill 4 cannot be discharged.

As the pushing means 5, for exaple, two or more pistons can be employed which are arranged centrally in the feeder funnel 2 and which move in the direction of the plug pipe 1. The pushing cylinders 6 operating these pistons can be fixed, e.g., to a partition wall provided in the plug pipe and/or in the feeder funnel. A cover plate 10 with slanting faces is appropriately provided above the pushing cylinders 6 so as to facilitate the supply of material into the feeder funnel 2.

Another possibility is that, as the pushing means, a substantially horizontal pressing roller 9 is used which is arranged at the upper end of the plug pipe 1 or of the feeder funnel 2 and which moves transversally to the plug pipe 1 back and forth, whereby the roller, acting like a rolling pin, both crushes any clogged material and forces the crushed material through the plug pipe into the jet mill. The pushing means crushes clogged material by pressure against the plug formed in pipe 1 and by interaction with the lower inclined walls 11 of funnel 2 which are inclined toward the inlet of pipe 1.

If the plug pipe 1 is connected to the jet mill 4 by means of an inclined additional pipe 3, it is appropriate to provide this additional pipe 3 with a screw feeder 8 whose centre part is provided with a through channel and which is driven, e.g., by an electric motor 8*a*. The main function of the screw feeder is to equalize the pulsed feeding movement produced by the pushing means, especially by pushing pistons, in the material.

The plug pipe 1 may be either vertical or inclined and of any arbitrary cross-sectional form, e.g. circular or angulaar. The cross-sectional area of the plug 1 is in the longitudinal direction of the pipe either throughout equal, or positively increased towards the jet mill 4.

By means of the feeding device in accordance with the present invention, an intake of air into the jet mill is avoided, so that the material is ground more uniformly so that its classification is simpler and easier. Moreover, the jet mill can be dimensioned as considerably smaller than earlier, because the ratio between the quantity of gas and the material to be ground contained in the mill can be kept at the optimum. It is remarkable advantage that the energy consumed by this feeder is only a fraction of the energy consumed by an ejector feeder.

It is evident that various details of the device can be formulated in many different ways within the scope of the invention.

What is claimed is:

1. A combined jet mill and device for feeding particulate material thereto and simultaneously disintegrating any clogged material, comprising:

a jet mill having an inlet for receiving particulate material;

a substantially vertical plug pipe having an upper inlet opening and a lower outlet opening;

a feed funnel for receiving particulate material connected to said inlet opening of said plug pipe;

at least one plunger means arranged for operation in said feed funnel and cooperable with at least one wall of said funnel to force particulate material from said funnel into said plug pipe to form a plug of material in said plug pipe;

said at least one plunger means comprising a cylinder connected to said feed funnel and a plunger piston movably mounted to said cylinder and in said feed funnel toward said inlet opening of said plug pipe;

an additional pipe connected to said outlet opening of said plug pipe and having an end connected to said inlet of said jet mill, for receiving compressed particulate material in the form of the plug from said pipe; and a screw feeder rotatably mounted in said additional pipe for conveying and disintegrating the material from said plug pipe to said jet mill;

whereby the plug of particulate material formed in said plug pipe by said at least one plunger means forms a gas-tight plug against admission of gas from said jet mill into said funnel.

2. A device according to claim 1, including second plunger means comprising a second cylinder connected to said feed funnel with a second plunger piston movably mounted therein toward said inlet opening of said plug pipe.

3. A device according to claim 2, wherein said plug pipe includes a partition therein extending from said inlet opening to said outlet opening, each of said first-mentioned and second plunger pistons movably mounted on opposite sides of said partition.

4. A device according to claim 3, including a cover plate on each of said first mentioned and second cylinders slanting downwardly into the interior of said feed funnel.

5. A device according to claim 3, wherein said feed funnel has lower inclined walls inclined inwardly toward said plug pipe inlet opening.

6. A device according to claim 3, wherein each of said cylinders is fixed to said partition, said partition extending upwardly beyond said inlet opening.

7. A device according to claim 6, including a cover plate on said cylinders having slanting faces slanting downwardly into an interior of said feed funnel.

8. A device according to claim 7, wherein said additional pipe is inclined at an angle with respect to said plug pipe, said outlet opening of said plug pipe opening into an intermediate location in said additional pipe.

9. A device according to claim 2, wherein said additional pipe is inclined at an angle with respect to said plug pipe, said outlet opening of said plug pipe opening into an intermediate location in said additional pipe.

* * * * *